US007156252B2

(12) United States Patent
Morin

(10) Patent No.: US 7,156,252 B2
(45) Date of Patent: Jan. 2, 2007

(54) CONTAINER CLOSURE WITH DUAL HEAT SEAL AND MAGNETIC SEAL

(75) Inventor: Jeremy E. Morin, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 278 days.

(21) Appl. No.: 10/836,731

(22) Filed: Apr. 30, 2004

(65) Prior Publication Data

US 2005/0242097 A1 Nov. 3, 2005

(51) Int. Cl.

| | |
|---|---|
| ***B65D 41/00*** | (2006.01) |
| ***B65D 51/00*** | (2006.01) |
| ***B32B 15/08*** | (2006.01) |
| ***B32B 3/02*** | (2006.01) |
| *B65D 6/28* | (2006.01) |
| *B65D 43/14* | (2006.01) |

(52) U.S. Cl. ..... 220/359.4; 220/230; 220/619; 220/359.3; 229/123.1; 229/125.35; 428/66.3; 428/347; 428/900

(58) Field of Classification Search ..... 220/359.4, 220/359.3, 254.1, 256.1, 257.2, 230, 641, 220/639, 619, 611, 613, 359.1; 428/66.3, 428/66.4, 66.6, 347, 349, 900; 229/125.14, 229/125.37, 125.13, 5.5, 245

See application file for complete search history.

(56) References Cited

U.S. PATENT DOCUMENTS

| | | | | |
|---|---|---|---|---|
| 2,761,717 | A | 9/1956 | Mahlke | |
| 3,274,964 | A * | 9/1966 | Griese, Jr. | 413/9 |
| 3,326,399 | A | 6/1967 | Ausnit | |
| 3,417,675 | A * | 12/1968 | Ausnit | 493/211 |
| 3,628,689 | A * | 12/1971 | Rogers | 220/270 |
| 3,961,721 | A | 6/1976 | Gordon et al. | |
| 4,215,797 | A * | 8/1980 | Chen | 220/359.4 |
| 4,253,584 | A * | 3/1981 | Bloeck et al. | 220/359.4 |
| 4,397,401 | A | 8/1983 | Ueno et al. | |
| 4,632,299 | A | 12/1986 | Holmberg | |
| 4,738,390 | A | 4/1988 | Brennan | |
| 4,771,936 | A * | 9/1988 | Dolby | 229/123.1 |
| 4,848,575 | A | 7/1989 | Nakamura et al. | |
| 4,948,038 | A | 8/1990 | Moeller | |
| 5,069,355 | A * | 12/1991 | Matuszak | 220/270 |
| 5,505,305 | A | 4/1996 | Scholz et al. | |
| 5,687,848 | A | 11/1997 | Scholz et al. | |
| 5,704,480 | A | 1/1998 | Scholz et al. | |
| 6,036,043 | A * | 3/2000 | Erfgen et al. | 220/270 |
| 6,037,168 | A | 3/2000 | Brown | |
| 2003/0132276 | A1 | 7/2003 | Metzler et al. | |
| 2005/0109784 | A1 * | 5/2005 | Varadarajan | 220/359.1 |

* cited by examiner

*Primary Examiner*—Robin A. Hylton
(74) *Attorney, Agent, or Firm*—Alston & Bird LLP

(57) ABSTRACT

A closure system for a container comprises a magnetically permeable element such as a metal ring adapted to be affixed on a container adjacent an opening thereof, and a closure such as a membrane lid having a surface formed by a heat seal material, the closure being heat-sealed to a surface of the magnetically permeable element via the heat seal material. The closure further incorporates a magnetized material structured and arranged to attract the magnetically permeable element so as to affix the closure to the magnetically permeable element following removal of the closure therefrom, whereby the closure system is re-closable by magnetic attraction between the closure and magnetically permeable element.

20 Claims, 1 Drawing Sheet

CONTAINER CLOSURE WITH DUAL HEAT SEAL AND MAGNETIC SEAL

BACKGROUND OF THE INVENTION

The invention relates to closures for containers. The invention relates more particularly to closures that are re-closable after initial opening.

A commonly used type of closure for consumer product containers used for packaging various types of products such as vegetable shortening, coffee, powdered drink mixes, and others, includes a metal ring double-seamed onto the top end of the container. The metal ring defines a large central opening for access to the product. A flexible membrane lid is heat-sealed to the top surface of the ring to seal the product in the container. To provide reclosability, a plastic overcap fits over the outer rim of the metal ring. After the membrane lid is peeled off the ring upon initial opening of the container, the overcap can be replaced to provide some level of protection of the remaining product from the outside environment.

The overcap adds a significant cost to the package. It would be desirable to omit the overcap, but then some other way of reclosing the package would be needed. It has been proposed to provide a pressure-sensitive adhesive (PSA) on the membrane lid so that it can be re-adhered to the metal ring after initial opening. However, when powdery products are contained in the package, the powder tends to contaminate the PSA and render it less tacky than what is required for a good re-seal.

BRIEF SUMMARY OF THE INVENTION

The present invention addresses the above needs and achieves other advantages, by providing a closure system for containers having a dual-seal arrangement employing a heat seal for initial sealing of the container closure and a magnetic seal for re-closing the closure after initial opening.

In one embodiment of the invention, the closure system comprises a magnetically permeable element adapted to be affixed on a container adjacent an opening thereof, and a closure having a surface formed by a heat seal material, the closure being heat-sealed to a surface of the magnetically permeable element via the heat seal material. The closure further incorporates a magnetized material structured and arranged to attract the magnetically permeable element so as to affix the closure to the magnetically permeable element following removal of the closure therefrom, whereby the closure system is re-closable by magnetic attraction between the closure and magnetically permeable element.

The magnetically permeable element can comprise a ferrous metal such as steel. The closure can comprise a flexible membrane lid having a heat seal layer and a magnetized layer joined to the heat seal layer. The magnetized layer comprises a polymer having particles of magnetized material dispersed therein. The polymer can comprise polyethylene and the particles can comprise barium ferrite or the like.

In an embodiment of the invention adapted particularly for containers for consumer products, a container and re-closable closure comprise a container body having a body wall that defines a top edge encircling an opening of the container body, a metal ring affixed to the top edge of the container body surrounding the opening, the metal ring defining an upper surface, and a membrane lid comprising a heat seal layer, a magnetized layer comprising polymer filled with magnetized particles joined to the heat seal layer, and a barrier layer joined to the magnetized layer. The membrane lid is heat-sealed to the upper surface of the metal ring for initial sealing of the container opening. The magnetized layer provides a magnetic attraction force between the membrane lid and the metal ring for re-closing the container after initial removal of the lid.

The magnetic attraction force between the lid and the ring is not affected by any product contamination that may exist on the upper surface of the ring. Thus, the closure system in accordance with the invention overcomes the problem associated with PSA-based re-close systems as noted above.

The barrier layer of the lid can comprise metal foil. A layer of nylon can be included between the metal foil layer and the magnetized layer. The membrane lid can further comprise a layer of polyester, such as polyethylene terephthalate, joined to the opposite side of the metal foil layer. The polyester layer can provide a suitable surface for receiving ink so that indicia and graphics can be printed on the lid, if desired.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
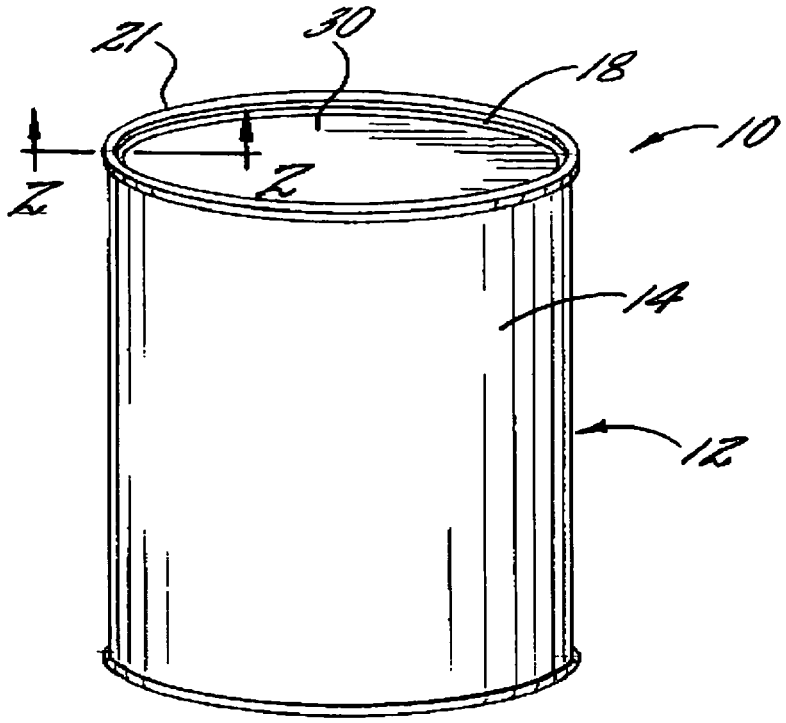
FIG. 1 is a perspective view of a container in accordance with one embodiment of the invention.
Figure 2:
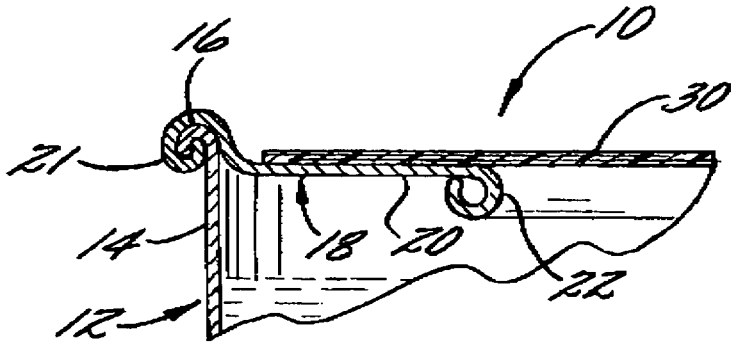
FIG. 2 is a cross-sectional view along line 2—2 in FIG. 1.
Figure 3:
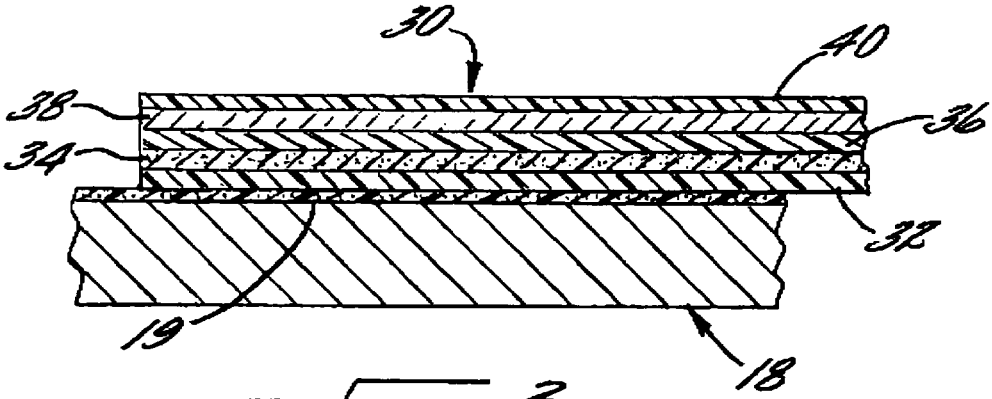
FIG. 3 is a greatly enlarged cross-sectional view showing details of the attachment of the flexible membrane lid to the metal ring.

A container assembly 10 in accordance with one embodiment of the invention are shown in FIGS. 1–3. The assembly 10 includes a container body 12 having a tubular side wall 14 that extends upwardly from a base of the container body and terminates at a top edge that encircles the top opening of the container. The container body can be formed in various configurations and can be made of various materials and by various processes. For instance, the container body can be formed of plastic, such as by blow-molding, injection-molding, or thermo-forming. Alternatively, the container body can comprise a composite container body formed by wrapping composite materials (paperboard, polymer film, and/or metal foil) about a forming mandrel or the like. At the top edge of the side wall 14, the container body defines a radially outwardly projecting flange or rim 16.

The container assembly further includes a magnetically permeable element in the form of a metal ring 18 that is seamed to the rim 16 of the container body. The ring 18 includes an outer curl 21 that fits over the rim 16, and the rim and curl are rolled together to create a seam therebetween, as known in the art. This method of attachment of a ring is sometimes referred to as double-seaming. However, other techniques for attaching the ring 18 can be used in the present invention. The ring defines an annular portion 20 that extends radially inwardly from the container body wall 14 and terminates at an inner edge 22, which can be curled as shown. The upper surface of the annular portion 20 provides a surface for attachment of a closure to the ring, as described below.

The ring 18 can comprise any magnetically permeable material such as ferrous metal. Advantageously, the ring can comprise steel. The steel can be plated with tin, as in electro-tin-plated (ETP) steel or the like.

The container assembly also includes a flexible membrane lid 30 affixed to the annular portion 20 of the ring 18. The lower surface of the lid 30 is defined by a heat seal layer 32. The heat seal layer can comprise any heat seal material capable of being heat-sealed to the upper surface of the ring 18. Examples of suitable heat seal materials include ionomer resins such as SURLYN® and TRANCEND® from Dupont, polypropylene-based compositions, and ethylene vinyl acetate-based or ethylene methyl-acrylate-based sealants.

The heat sealing of the lid to the ring can employ an easy-peel system so that the lid can readily be peeled off in one piece. Various easy-peel heat seals are known in the art and can be employed in the present invention. One such easy-peel heat seal, for example, employs a heat seal material such as polypropylene and a particulate mineral filler dispersed in the heat seal material for reducing the peel force needed to peel the heat seal apart. Thus, as an example, a layer of contaminated polypropylene 32 can be provided on the lid 30, and a coating 19 of polypropylene can be provided on the ring 18.

Alternatively, the easy-peel system can employ a coating 19 on the ring comprising an epoxy resin in which polypropylene is dispersed, whereby the polypropylene forms tiny islands in the epoxy matrix, which serve as bonding sites. The lid can then include a heat seal layer 32 of polypropylene for bonding to the bonding sites on the ring coating.

The membrane lid 30 further comprises a magnetized layer 34 joined to the heat seal layer 32. The magnetized layer comprises a polymer having particles of magnetized material dispersed therein and oriented with the magnetic axes of the particles substantially perpendicular to the plane of the layer 34. Magnets of this type are sometimes referred to as bonded magnets. Processes for forming such magnets are known in the art and hence are not described herein for the sake of brevity. The polymer can comprise various materials, such as polyethylene. The magnetized material can comprise various materials. Barium ferrite is an example of a suitable magnetized material, but others can be used, such as samarium cobalt, neodymium-iron-boron, and the like.

The lid 30 further includes a layer 36 of a polyamide such as nylon joined to the magnetized layer 34 on one side and to a metal foil layer 38 on the other side. The metal foil layer 38 serves as the primary moisture and oxygen barrier for the lid. The nylon layer provides tear-resistance to the lid. The uppermost layer of the lid, joined to the metal foil layer, is a polyester layer 40. The polyester layer can comprise polyethylene terephthalate, which can be oriented. This material can provide a suitable surface for receiving ink so that the lid can be printed with indicia and graphics.

The construction of the lid 30 described and illustrated herein is given only by way of example, and various other types and numbers of layers can be included in a lid in accordance with the invention. The key components of any lid in accordance with the invention are a magnetized component and a heat seal component; any additional components are optional.

It will also be appreciated that a closure assembly in accordance with the invention can take on various forms, and is not limited to a metal ring and membrane lid as illustrated and described herein. More generally, the closure assembly can comprise any magnetically permeable element in combination with a closure having a magnetized component and a heat seal component.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A closure system for a container, comprising:

a magnetically attractable element adapted to be affixed on a container adjacent an opening thereof; and a closure having a surface formed by a heat seal material, the closure being heat-sealed to a surface of the magnetically attractable element via the heat seal material, the closure further incorporating a magnetized material structured and arranged to attract the magnetically attractable element so as to affix the closure to the magnetically attractable element following removal of the closure therefrom, whereby the closure system is re-closable by magnetic attraction between the closure and magnetically attractable element, wherein the closure comprises a flexible membrane lid, the lid having a lower layer formed by the heat seal material and a magnetized layer joined to the lower layer, the magnetized layer incorporating the magnetized material.

2. The closure system of claim 1, wherein the magnetically attractable element comprises metal.

3. The closure system of claim 2, wherein the magnetically attractable element comprises a metal ring adapted to be affixed to an open top end of a container body.

4. The closure system of claim 1, wherein the magnetized layer comprises a polymer having particles of the magnetized material dispersed therein.

5. The closure system of claim 4, wherein the particles comprise barium ferrite.

6. The closure system of claim 4, wherein the polymer of the magnetized layer comprises polyethylene.

7. The closure system of claim 1, wherein the membrane lid further comprises a barrier layer providing a barrier against transmission of at least one of moisture and oxygen.

8. The closure system of claim 1, wherein the membrane lid comprises, in order from lower to upper surface, a heat seal layer, a layer of polyethylene filled with magnetized particles, a tear-resistant layer, a metal foil layer, and a polyester layer.

9. The closure system of claim 8, wherein the tear-resistant layer comprises nylon.

10. The closure system of claim 8, wherein the polyester layer comprises polyethylene terephthalate.

11. The closure system of claim 8, wherein the heat seal layer comprises ionomer resin.

12. The closure system of claim 8, wherein the heat seal layer comprises polypropylene.

13. A container and re-closable closure, comprising:

a container body having a body wall that defines a top edge encircling an opening of the container body;

a magnetically attractable metal ring affixed to the top edge of the container body surrounding the opening, the metal ring defining an upper surface; and a membrane lid comprising a heat seal layer, a magnetized layer comprising polymer filled with magnetized particles joined to the heat seal layer, and a barrier layer joined to the magnetized layer, the membrane lid being heat-sealed to the upper surface of the metal ring for initial sealing of the container opening, the magnetized layer providing a magnetic attraction force between the membrane lid and the metal ring for re-closing the container after initial removal of the lid.

14. The container and re-closable closure of claim 13, wherein the magnetized layer comprises polyethylene.

15. The container and re-closable closure of claim 13, wherein the magnetized layer comprises particles of barium ferrite.

16. The container and re-closable closure of claim 13, wherein the barrier layer comprises metal foil.

17. The container and re-closable closure of claim 13, wherein the membrane lid further comprises a layer of polyester joined to the barrier layer.

18. The container and re-closable closure of claim 17, wherein the polyester comprises polyethylene terephthalate.

19. The container and re-closable closure of claim 13, wherein the heat seal layer of the membrane lid comprises polypropylene contaminated with mineral filler, and further comprising a coating of polypropylene on the metal ring for bonding with the heat seal layer.

20. The container and re-closable closure of claim 13, wherein the heat seal layer of the membrane lid comprises polypropylene, and further comprising a coating on the metal ring for bonding with the heat seal layer, the coating comprising epoxy having polypropylene dispersed therein.

* * * * *